US008776670B2

(12) United States Patent
Lapp et al.

(10) Patent No.: US 8,776,670 B2
(45) Date of Patent: Jul. 15, 2014

(54) PISTON ASSEMBLY

(75) Inventors: Michael T. Lapp, Bloomfield, MI (US); Grace Zhao, Novi, MI (US); Mike L. Wilder, Morristown, TN (US); Dieter Gabriel, Highland, MI (US)

(73) Assignee: Mahle International GmbH (GB)

( * ) Notice: Subject to any disclaimer, the term of this patent is extended or adjusted under 35 U.S.C. 154(b) by 936 days.

(21) Appl. No.: 12/706,965

(22) Filed: Feb. 17, 2010

(65) Prior Publication Data

US 2011/0197758 A1 Aug. 18, 2011

(51) Int. Cl.
*F02F 3/00* (2006.01)
*F02F 3/22* (2006.01)

(52) U.S. Cl.
USPC ..... 92/186; 92/214; 92/224; 92/231

(58) Field of Classification Search
USPC ..... 92/186, 208–239, 153, 158, 159, 181 R, 92/260; 123/41.35–41.39, 41.42, 193.6; 29/888.044, 888.042, 463, 525.14
See application file for complete search history.

(56) References Cited

U.S. PATENT DOCUMENTS

| | | | | |
|---|---|---|---|---|
| 1,557,871 | A * | 10/1925 | Painter | 92/186 |
| RE34,139 | E * | 12/1992 | Cooper et al. | 123/193.6 |
| 6,260,472 | B1 | 7/2001 | Zhu et al. | |
| 6,499,387 | B2 * | 12/2002 | Bedwell | 92/216 |
| 6,938,537 | B2 * | 9/2005 | Scharp | 92/186 |
| 2002/0124721 | A1 * | 9/2002 | Bedwell | 92/222 |
| 2003/0188633 | A1 * | 10/2003 | Griffiths et al. | 92/208 |
| 2007/0039460 | A1 * | 2/2007 | Scharp | 92/186 |

FOREIGN PATENT DOCUMENTS

| | | | | |
|---|---|---|---|---|
| DE | 10152316 | A1 | 7/2002 | |
| WO | WO 2006034862 | A1 * | 4/2006 | F02F 3/00 |

OTHER PUBLICATIONS

Machine Translation of "Gniesmer et al. (WO 2006034862 A1), Simple Fricition Weld, Apr. 6, 2006".*

* cited by examiner

*Primary Examiner* — F. Daniel Lopez
(74) *Attorney, Agent, or Firm* — Rader, Fishman & Grauer PLLC

(57) ABSTRACT

A piston assembly and a method of making the same. Exemplary piston assemblies may include a piston crown having a ring belt portion defining a cooling gallery, and a strut extending away from the ring belt portion to define a wrist pin bore. The piston may further include a piston skirt assembly secured to the strut. The piston skirt assembly may include two separate portions that each have a closure plate formed integrally with the portion, with the closure plate generally enclosing the cooling gallery. Exemplary methods of assembling a piston may include providing a piston crown having a ring belt portion defining a cooling gallery and a strut extending away from the ring belt portion to define a wrist pin bore. The methods may further include forming a piston skirt assembly having two portions having a closure plate integrally formed therewith, and securing the skirt to the crown.

23 Claims, 6 Drawing Sheets

PISTON ASSEMBLY

BACKGROUND

Internal combustion engine manufacturers are constantly seeking to increase power output and fuel efficiency of their products. One method of generally increasing efficiency and power is to reduce the oscillating mass of an engine, e.g., of the pistons, connecting rods, and other moving parts of the engine. Engine power may also be increased by raising the compression ratio of the engine. Raising the compression ratio of an engine also generally raises the pressure and temperature within the combustion chamber during operation.

Engines, and in particular the pistons, are therefore under increased stress as a result of these reductions in weight and increased pressures and temperatures associated with engine operation. Piston cooling is therefore increasingly important for withstanding the increased stress of such operational conditions over the life of the engine.

To reduce the operating temperatures of piston components, a cooling gallery may be provided about a perimeter of the piston. Crankcase oil may be introduced to the cooling gallery, and may be distributed about the cooling gallery by the reciprocating motion of the piston, thereby reducing the operating temperature of the piston.

At the same time, the cooling galleries may increase overall complexity of the piston assembly. For example, cooling galleries may require additional parts, such as cooling gallery covers, in order to encourage proper circulation of a coolant throughout the cooling gallery. For example, a cooling gallery may rely on a cover plate fitted to the piston crown that generally traps oil within the cooling gallery, thereby increasing the cooling effect of the gallery.

Accordingly, there is a need for a piston that minimizes overall piston weight and complexity, while also allowing adequate cooling, such as by providing a cooling gallery.

BRIEF DESCRIPTION OF THE DRAWINGS

While the claims are not limited to the illustrated examples, an appreciation of various aspects is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows:

DETAILED DESCRIPTION

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Various exemplary illustrations are provided herein for a piston assembly and a method of making the same. Exemplary piston assemblies may include a piston crown having a ring belt portion defining a cooling gallery, and a strut extending away from the ring belt portion to define a wrist pin bore. The piston may further include a piston skirt assembly secured to the strut. The piston skirt assembly may include two separate portions that each have a closure plate formed integrally with the portion, with the closure plate generally enclosing the cooling gallery. As described further below, the crown and skirt may each be formed of different materials and/or formed in different types of forming processes.

Exemplary methods of assembling a piston may include providing a piston crown having a ring belt portion defining a cooling gallery and a strut extending away from the ring belt portion to define a wrist pin bore. The methods may further include forming a piston skirt assembly having two portions having a closure plate integrally formed therewith, and securing the skirt to the crown such that the closure plates generally cooperate to enclose the cooling gallery.

Figure 1:
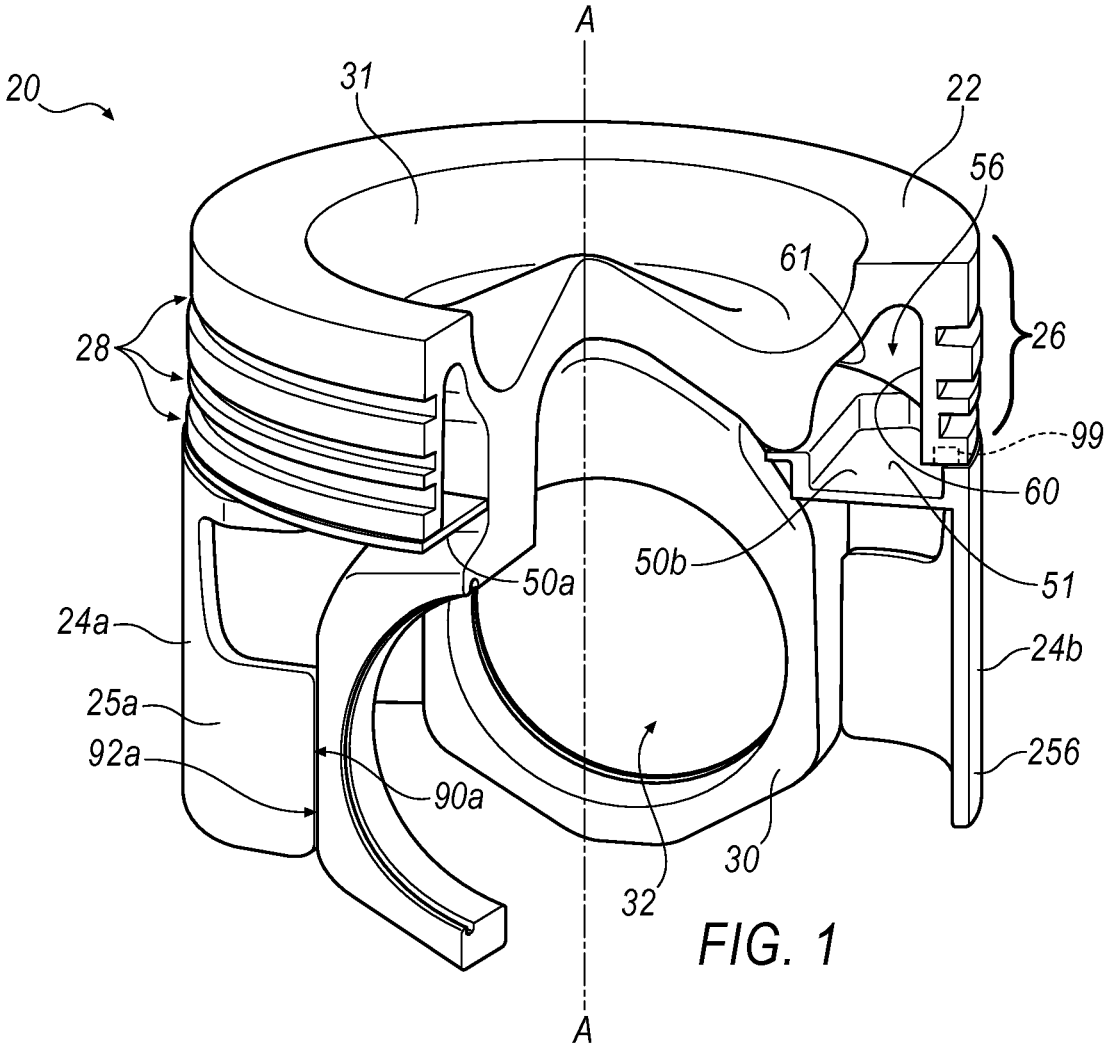
FIG. 1 is a perspective view of an exemplary piston assembly.

Turning now to the drawings and in particular to FIG. 1, an exemplary piston 20 for an internal combustion engine is disclosed. In the illustration of FIG. 1, a piston crown 22 is fixedly joined to a piston skirt 24. The piston crown 22 includes a ring belt portion 26 and a combustion bowl 31. The ring belt portion 26 includes a plurality of ring grooves 28*a*, 28*b*, and 28*c* (collectively, 28) for receiving piston rings (not shown) at least partially therein. In particular, the ring belt portion 26 may include a first ring groove 28*a*, a second ring groove 28*b* and a third ring groove 28*c*. The third ring groove 28*c* may have an oil control ring (not shown) disposed therein.

The piston crown 22 includes a strut 30 that extends away from the ring belt portion 26. The strut 30 defines a wrist pin bore 32 for receiving a wrist pin (not shown) to affix piston 20 to a connecting rod (not shown). The strut 30 may be formed integrally with the ring belt portion 26, e.g., in a casting operation or progressive forging operation, as will be described further below.

The crown 22 may also define in part a cooling gallery 56 that generally extends about the perimeter of the crown 22, as will be described further below. The cooling gallery 56 is configured to circulate a coolant, e.g., engine oil, thereby reducing an operating temperature of the piston 20, e.g., during engine operation. Additionally, the circulation of the coolant or oil may maintain a more stable or uniform temperature about the crown 22 and/or skirt 24.

The piston skirt 24 generally supports the crown 22 during engine operation, e.g., by interfacing with surfaces of an engine bore (not shown) to stabilize the piston 20 during reciprocal motion within the bore. For example, the skirt 24 generally defines a circular outer shape about at least a portion of a perimeter of the piston 20 corresponding to the cylindrical engine bore surfaces. The circular skirt surfaces may generally slide along the bore surfaces as the piston 20 moves reciprocally within the bore.

As best seen in FIG. 1, the skirt 24 includes two separate skirt portions 24*a*, 24*b*, each of which includes a closure plate 50*a* or 50*b* (collectively, 50) and a lower portion 25. The closure plates 50*a*, 50*b* generally cooperates to enclose the cooling gallery 56, while the lower portions 25 generally interface with bore surfaces (not shown) of the engine receiving the piston 20. The cooling gallery 56 is located within the piston 20, e.g., within the ring belt portion 26 of the crown 22, and is generally defined at least in part by surfaces of the crown 22, e.g., an annular ring belt wall 60 and a combustion bowl wall 61. Accordingly, the cooling gallery 56 is generally bounded by the closure plate 50, the combustion bowl wall 61 and the annular ring belt wall 60. The cooling gallery 56 may also include one or more fluid inlet and/or outlet apertures (not shown in FIG. 1) for allowing coolant to enter and exit the cooling gallery 56, respectively.

The closure plates 50, as best seen in FIG. 1, generally allow an increased overall size of the cooling gallery 56. For example, the closure plate 50*b* includes a recess 51, such that the cooling gallery 56 extends below a lower, e.g., lowermost, portion of the ring belt portion 26 of the crown 22. An overall size or shape of the cooling gallery 56 may thus be enlarged by the closure plate 50 as compared with closure plates that define a generally flat shape across bottom surfaces of a piston cooling gallery.

In examples where the skirt 24 is provided in two separate portions 24*a*, 24*b* that are disposed on opposing sides of the strut 30 and/or wrist pin bore 32, each skirt portion 24*a*, 24*b* may be secured separately to the crown 22. For example, each skirt portion 24*a*, 24*b* may be secured along the strut 30, as will be described further below. The skirt portions 24*a*, 24*b* each include separate closure plate portions 50*a*, 50*b* that cooperate to form the closure plate 50 upon assembly of the skirt portions 24*a*, 24*b* to the crown 22. As will be described further below, the skirt portions 24*a*, 24*b* may each be formed separately, or may be initially formed as a single skirt 24 and separated to allow assembly to the crown 22. Additionally, in some examples the skirt assembly 24 may be provided as a single integral piece instead of two separate portions 24*a*, 24*b*. For example, a one-piece skirt 24 may be sized with an inner diameter to allow the skirt 24 to be fit over the strut 30 to allow the skirt 24 to be assembled to the crown 22.

The closure plate 50 may generally be integrally formed in a single piece with the lower portions 25 of the respective skirt 24 or skirt portions 24*a*, 24*b*, e.g., in a forging or casting operation. For example, in one illustration the closure plate 50 and skirt 24 are formed in a progressive stamping or forging process from a single blank.

Figure 3:
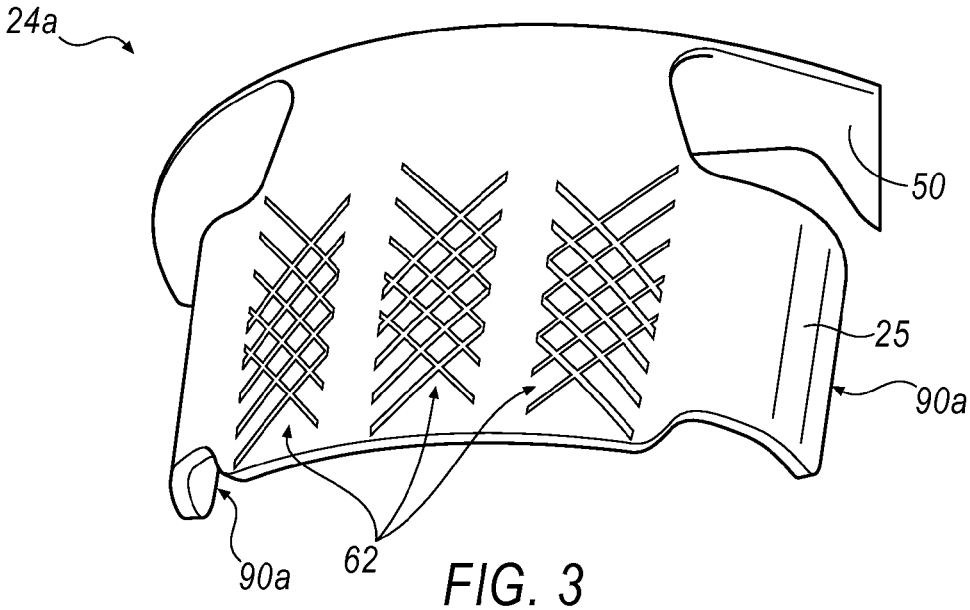
FIG. 3 is a lower perspective view of an outer surface of the exemplary skirt portion of FIGS. 1 and 2.

As best seen in FIG. 3, which illustrates one of the skirt portions 24*a*, the skirt portions 24*a*, 24*b* may include a surface texture 62 on the surface(s) that interface with the bore surface during engine operation. For example, the surface texture 62 may present an undulating surface with respect to the circular bore surface. An undulating surface may reduce friction at an interface between the skirt 24 and the bore surface, for example by allowing an amount of engine oil or other lubricant to accumulate at least temporarily in pockets formed by the complementary shapes of the surface texture 62 of the skirt 24 and the engine bore. Additionally, surface undulations or texture on the interfacing surface(s) of the skirt 24 may accumulate small debris that would otherwise interfere with the frictional interface between the skirt 24 and the bore surfaces. The surface texture 62 may be relatively small in magnitude, e.g., less than a millimeter in depth with respect to the circular shape of the skirt 24. In one illustration, the surface texture 62 is formed on a surface of the skirt 24 in a knurling process.

Figure 2:
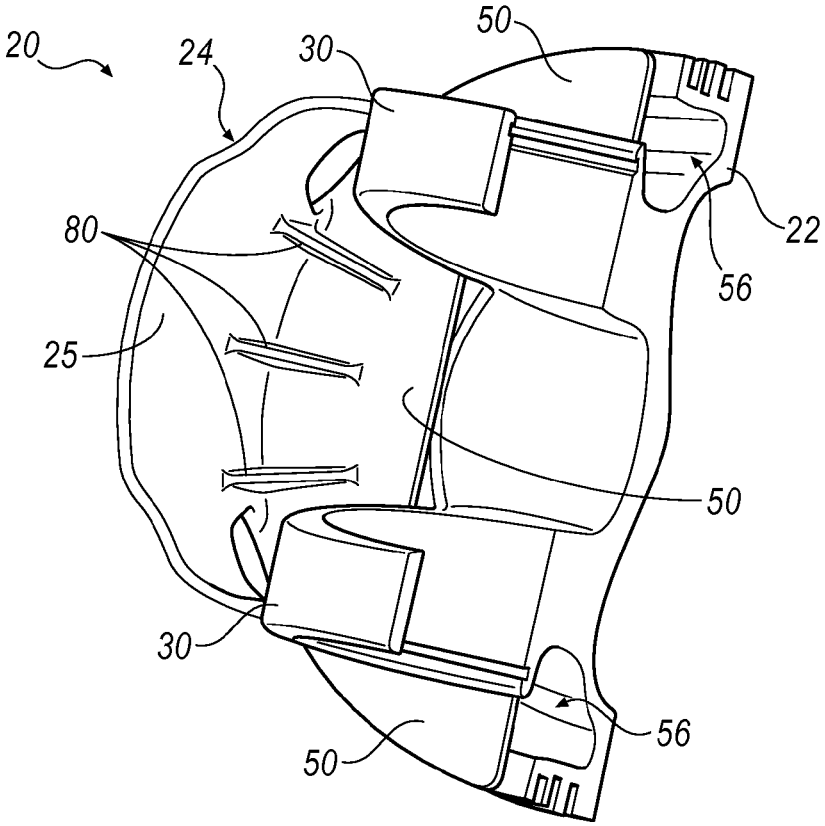
FIG. 2 is a lower perspective cutaway view of the piston assembly of FIG. 1, with the section taken through the wrist pin bore.

As best seen in FIG. 2, the skirt 24 may include one or more stiffening webs 80 that extend between the lower portion 25 of the skirt 24 and the closure plate 50. Stiffening webs 80 may generally provide additional stiffness to the skirt 24, e.g., by their extension in a plane generally normal to the closure plate 50 and/or the lower portion 25 of the skirt 24, and securement to both the closure plate 50 and lower portion 25 of the skirt 24. In the exemplary illustration shown in FIG. 2, the stiffening webs 80 are formed integrally with the closure plate 50 and/or skirt 24, e.g., by forging or stamping, merely as examples.

The piston crown 22 and the piston skirt 24 may be secured or fixedly joined to one another in any manner that is convenient including, but not limited to, beam welding, laser welding, form-locking, adhesive bonding, or mechanical fastening with one or more bolts, screws, etc. For example, as best seen in FIG. 1, each skirt portion 24*a*, 24*b* may be secured to the strut 30 along corresponding mating surfaces 90, 92 defined by the skirt portions 24*a*, 24*b* and strut 30, respectively. More specifically, the skirt portion 24*a* may define a skirt mating surface 90*a* that is welded to a strut mating surface 92*a*. Similarly, the skirt portion 24*b* defines a skirt mating surface 90*b* that is welded to a second strut mating surface 92*b* disposed on an opposite side of the wrist pin bore 32 with respect to the first strut mating surface 92*a*.

As shown in FIG. 1, the mating surfaces 90, 92 may be substantially parallel to a longitudinal axis A-A of the crown 22 and/or piston 20. The mating surfaces may also extend substantially straight, as shown. The mating surfaces 92, i.e., where the crown 22 and skirt 24 are permanently joined, may be limited to the strut 30, thereby simplifying assembly of the skirt portions 24 to the crown 22. In other words, the skirt portions 24*a*, 24*b* may be secured to the crown 22 in a permanent securement process, e.g., welding, only along the mating surfaces 90, 92, eliminating any need to weld or otherwise permanently secure other areas of the skirt 24 to the crown 22.

In one exemplary illustration, the closure plate 50 and crown 22 may be engaged with each other in a non-permanent fashion, in contrast to a permanent securement of the skirt 24 to the crown 22, e.g., by welding. For example, the closure plate 50 and crown 22 may be engaged in a register/recess arrangement, e.g., where an extension of one of the closure plate 50 and crown 22 is received in a recess of the other. In one illustration, the closure plate 50 may define an extension or lip (not shown in FIGS. 1-3) that engages the crown 22. Further, the crown 22 may define a recess or slot 99 (shown optionally in FIG. 1 in dotted lines), thereby providing additional radial support to the upper portion of the skirt 24 and closure plate 50 adjacent the ring belt portion 26. In other words, the extension/recess arrangement may provide additional radial stiffness to the skirt 24 where it is engaged with the crown relative to bore surfaces adjacent the skirt 24. Alternatively, the closure plate 50 may be secured to the crown in a permanent fashion, e.g., by welding along a portion of the perimeter of the closure plate 50, to provide additional stability or strength to the piston 20.

By fixedly joining the piston crown 22 and the piston skirt 24, the piston 20 is generally formed as a one-piece or "monobloc" piston assembly. That is, the piston crown 22 is generally unitized with the piston skirt 24, such that the piston skirt 24 is immovable relative to the piston crown 22 after securement to the crown 22.

Piston crown 22 and piston skirt 24 may be constructed from any materials that are convenient. In one exemplary illustration, the crown 22 and skirt 24 are formed of the same material. In another example, the piston crown 22 may be formed of a different material than the piston skirt 24. Accordingly, a material used for the piston crown 22 may include different mechanical properties, e.g., yield point, tensile strength or notch toughness, than the piston skirt 24. Merely as examples, the crown 22 may be formed of a steel material, cast iron, or aluminum material, with the skirt 24 being formed of a cast iron, composite, aluminum, powdered metal. Any other material or combination may be employed for the crown 22 and skirt 24 that is convenient. The crown 22 and skirt 24 may also be formed in different processes, e.g., the crown 22 may be a generally single cast piece, while the skirt 24 may be forged. Any material and/or forming combination may be employed that is convenient.

Figure 4:
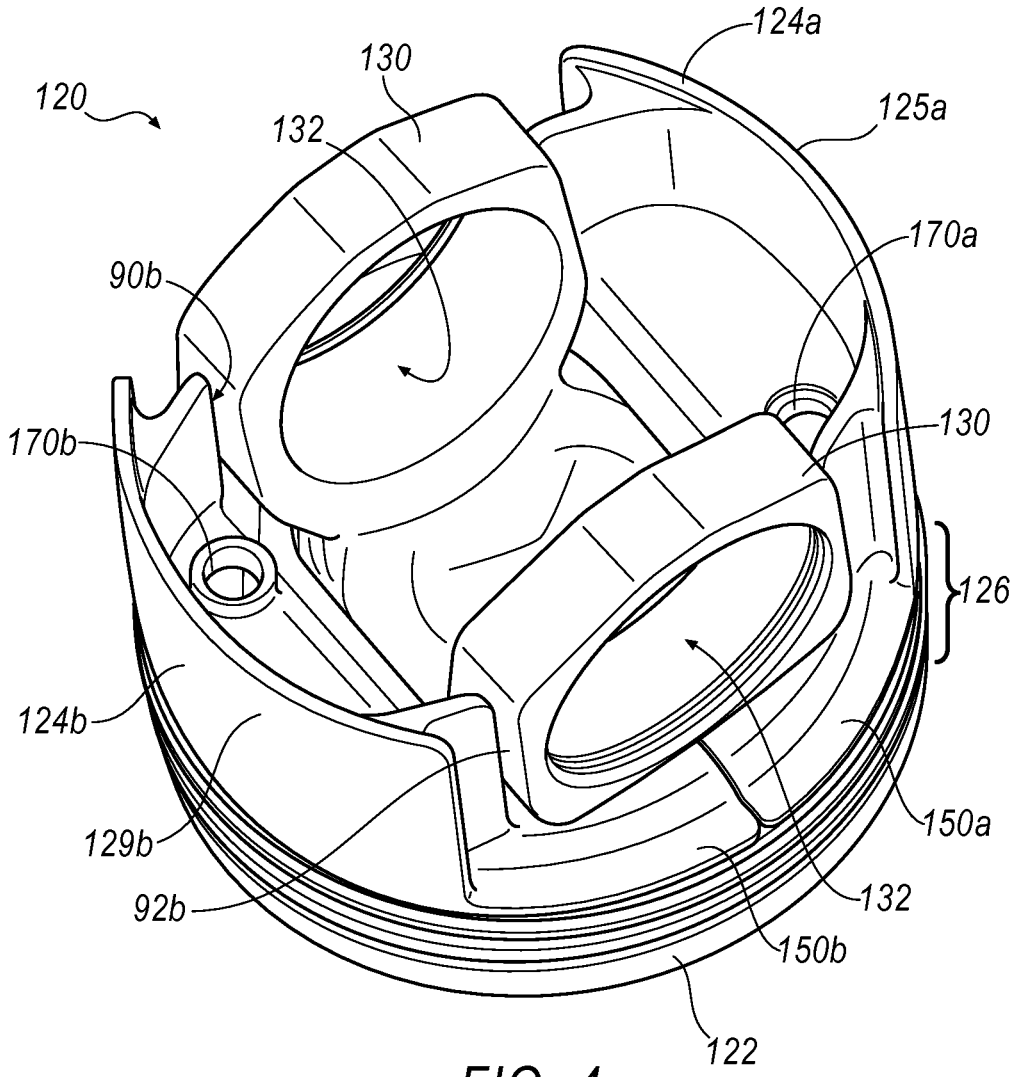
FIG. 4 is a perspective view of another exemplary piston assembly.
Figure 5:
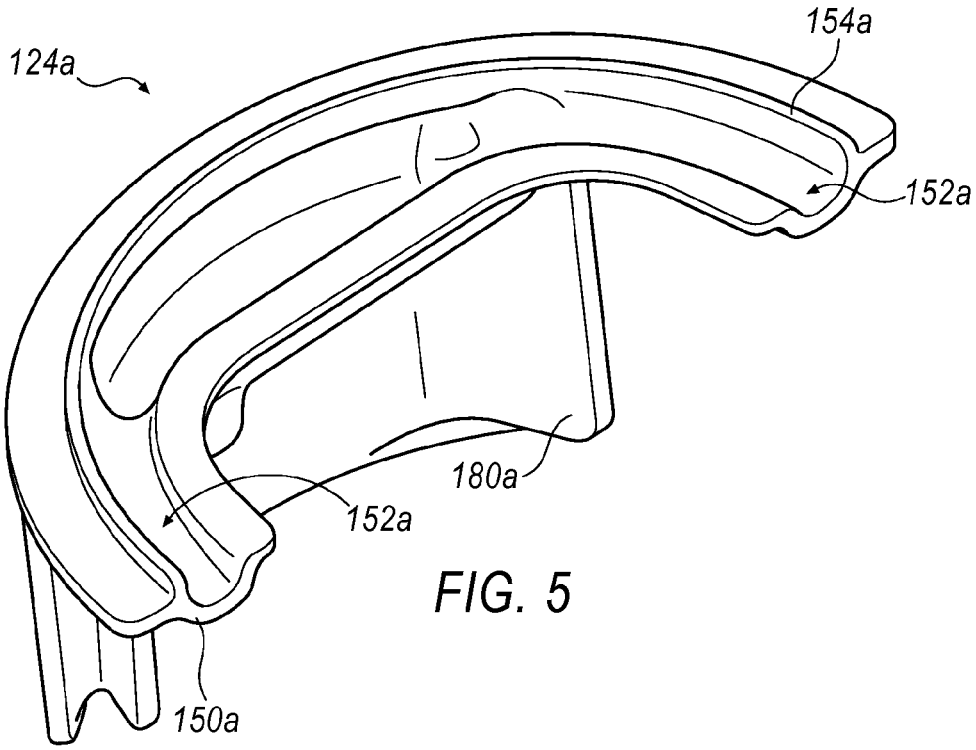
FIG. 5 is a perspective view of the exemplary skirt portion of FIG. 4.
Figure 6:
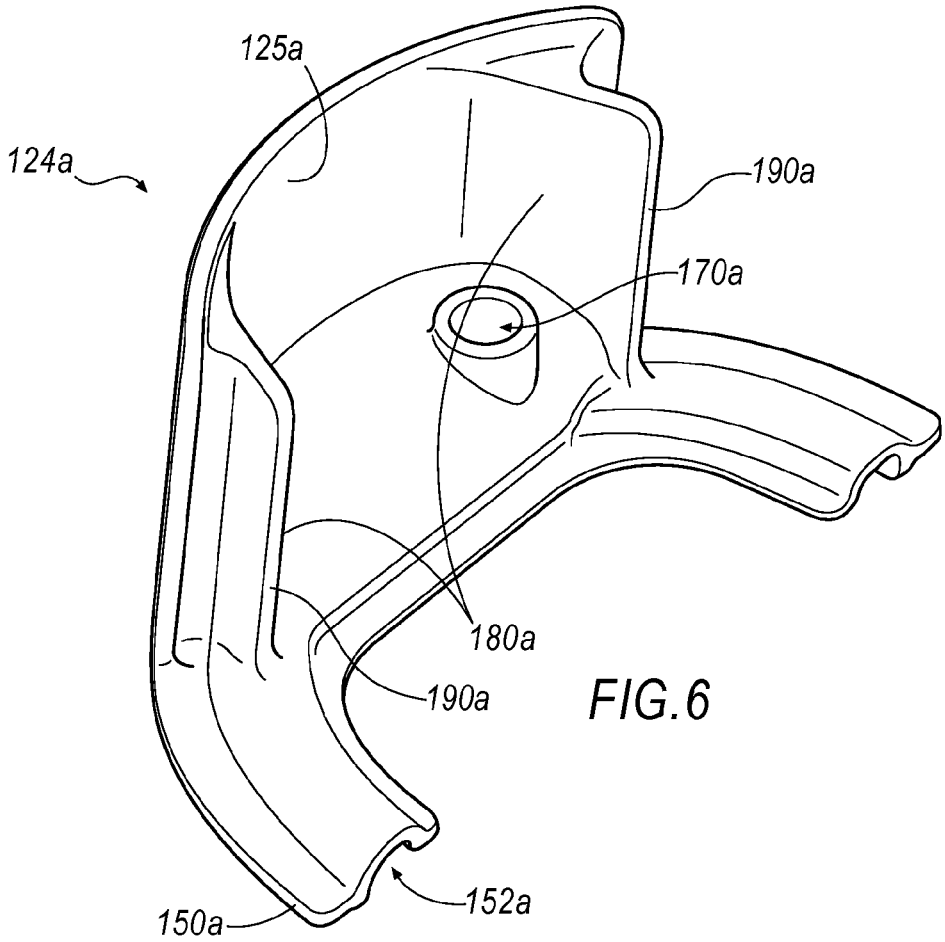
FIG. 6 is another perspective view of the exemplary skirt portion of FIG. 4.

Turning now to FIGS. 4-6, another exemplary piston assembly 120 is illustrated having a crown 122 and skirt assembly 124. The skirt assembly 124 includes two skirt portions 124*a*, 124*b*. Although not specifically shown in FIG. 4, the crown 122 may define in part a cooling gallery (not shown) that generally extends about the perimeter of the crown 122, substantially as shown above in the exemplary piston 20. The skirt 124 may include two separate skirt portions 124*a*, 124*b*, each of which includes a closure plate 150. The closure plates 150*a*, 150*b* generally cooperate to enclose the cooling gallery (not shown in FIGS. 4-6).

One or more fluid inlet and/or outlet apertures 170*a*, 170*b* (collectively, 170) may be provided, e.g., in the closure plates 150*a*, 150*b*, respectively, to allow coolant to enter and exit the cooling gallery. The fluid inlet aperture 170*a* may be in communication with one or more nozzles (not shown) in operation within the piston 120 for directing fluid, e.g., crankcase oil, into the cooling gallery (not shown in FIGS. 4-6). As described above in regard to the piston 20, fluid in the cooling gallery may generally cool the inside walls of the cooling gallery by way of the reciprocating motion of the piston 120 when in operation with an internal combustion engine (not shown). Fluid introduced into the cooling gallery 56 may be permitted to escape through one or more fluid outlet apertures 170*b* for drainage back into the crank case of the engine (not shown). Additionally, annular passageways (not shown) may be provided that extend from the cooling gallery radially outward to the outer surfaces of the piston 120, e.g., adjacent bore surfaces interfacing with the piston 120, thereby promoting coolant circulation by allowing additional entry/egress of coolant to/from the cooling gallery.

As best seen in FIGS. 5 and 6, which illustrates one exemplary skirt portion 124*a*, the closure plate 150*a* may define a recess or coolant channel 152*a* that extends generally about the periphery of the closure plate 150 and provides a path for coolant (not shown) to run about the cooling gallery during operation. While only skirt portion 124*a* is illustrated in FIGS. 5 and 6, the skirt portion 124*b* may have a recess or coolant channel as described for skirt portion 124*a*. Additionally, longitudinal extension of the channel 152 may provide additional cooling gallery capacity, i.e., by lengthening a longitudinal extent of the cooling gallery enclosed by the closure plates 150*a*, 150*b* with respect to a longitudinal axis of the piston 120.

As best seen in FIG. 5, skirt portion 124*a* may be provided with an extension lip 154*a* that extends about at least a portion, or even an entire portion, of a periphery of the piston 120. While only skirt portion 124*a* is illustrated in FIGS. 5 and 6, skirt portion 124*b* may be provided with an extension lip as described for skirt portion 124*a*. The extension lip 154*a* may be engaged with the crown 122 in a variety ways, both permanent and non-permanent.

For example, the extension lip 154, closure plate 150 and crown 122 may be engaged with each other in a non-permanent fashion, in contrast to permanently securing the skirt 124 to the crown 122, e.g., by welding. For example, the closure plate 150 and crown 122 may be engaged in a register fashion, e.g., where an extension of one of the closure plate 150 and crown 122 is received in a recess of the other. For example, as best seen in FIG. 5, the closure plate 150 may define an extension lip 154 that is received within a slot (not shown in FIGS. 4-6) of the crown 122, thereby supporting the upper portion of the skirt 124 and closure plate 150 radially with respect to the crown 122.

As shown in FIGS. 5 and 6, skirt portion 124*a* may include one or more stiffening webs 180*a* that extend between the lower portion 125 of the skirt portions 124 and the closure plate 150. The stiffening web 180*a* may generally provide additional stiffness to the skirt portion 124*a*, e.g., by an extension of the webs 180*a* in a plane extending generally normal to the closure plate 150*a*. The stiffening web 180*a* may be secured to both the closure plate 150*a* and lower portion 125*a* of the skirt 124*a*. For example, the stiffening webs 180*a* may be formed integrally with the closure plate 150 and/or skirt portion 124*a*, e.g., by forging, stamping, or casting, merely as examples. While skirt portion 124*a* is shown in FIGS. 5 and 6, skirt portion 124*b* may be provided with a stiffening web in the same manner as described for skirt portion 124*a*.

Figure 7:
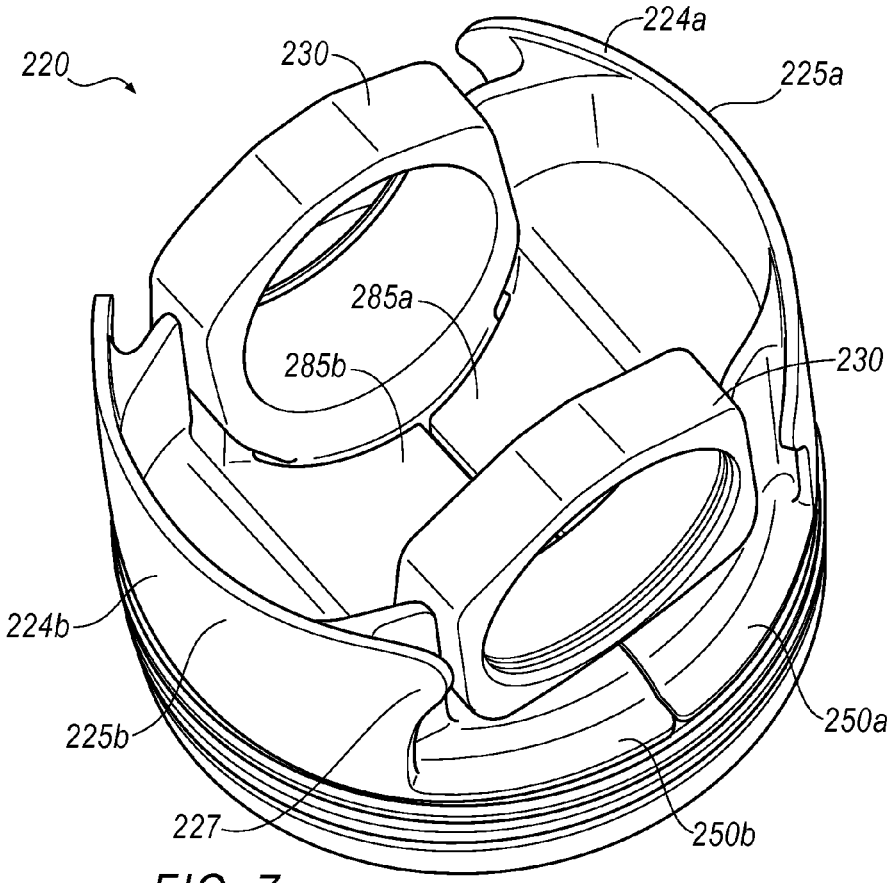
FIG. 7 is a perspective view of another exemplary piston assembly.
Figure 8:
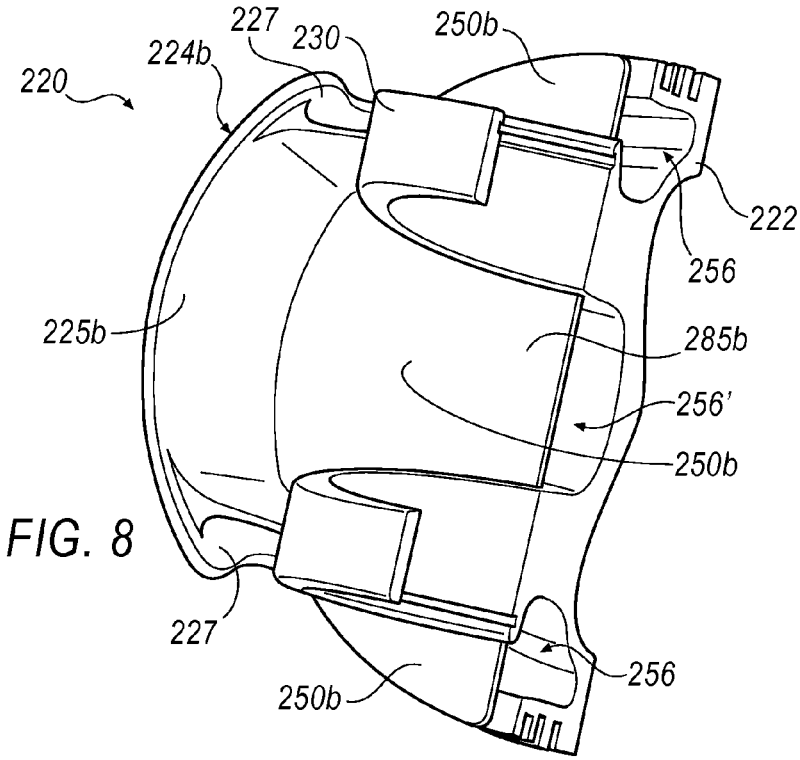
FIG. 8 is a lower perspective cutaway view of the piston assembly of FIG. 7, with the section taken through the wrist pin bore.

Turning now to FIGS. 7 and 8, another exemplary piston assembly 220 is illustrated. Piston assembly 220 includes a crown 222 and skirt assembly 224 comprised of a first skirt portion 224*a* and second skirt portion 224*b*, similar to piston assemblies 20, 120. The skirt portions 224*a*, 224*b* each include an extended lip 285*a*, 285*b*, respectively, that extend toward one another, generally through the center of the piston assembly 220. For example, as best seen in FIG. 7, the extended lips 285*a*, 285*b* extend toward one another through the strut 230, and cooperate to define a relatively small gap between the ends of the lips 285*a*, 285*b*. In this matter, the cooling gallery 256 defined by the skirt portions 224 and crown 222 may generally extend toward the center of the piston assembly 220. For example, as best seen in FIG. 8 a center portion 256' of the gallery is generally defined by the closure plate 250*b* and crown 222. During operation, oil or other coolants/lubricants circulating through the gallery may travel through this center portion 256' of the cooling gallery 256 to the gap between the extended lips 285, and may exit the center portion 256' via the gap. Accordingly, the oil may generally fall back to the engine crankcase (not shown), and may also generally lubricate the interface between the strut 230, connecting rod (not shown), and wrist pin (not shown) adjacent the gap, thereby providing cooling and/or lubrication to these areas of the piston assembly 220, wrist pin, and/or connecting rod. A gap defined between the closure plates 250*a*, 250*b* may be provided alternatively or in addition to other entry/exit apertures of the cooling gallery 256 (e.g., apertures 170 in skirt portions 124 shown in FIG. 4), thereby allowing circulation of a coolant or lubricant through the cooling gallery 256 to be further customized for a given application.

Lower portions 225*a*, 225*b* of the skirt portions 224*a*, 224*b* (skirt portion 224*a* not shown in FIG. 8) may have a flash portion 227 on opposing sides of the lower portions 225. These flash portions 227 may result where skirt portions 224 are formed in a forging process. By contrast, a generally straight edge, e.g., as shown in the piston assembly 120 in FIG. 4, may be provided on the sides of the lower portions 225 of the skirt portions 224 where the skirt 224 is formed in, merely as an example, a casting operation. The flash portions 227 generally cooperate to provide an overall "bell" shape to each of the lower portions 225, e.g., when viewing the lower portions 225 laterally.

Figure 9:
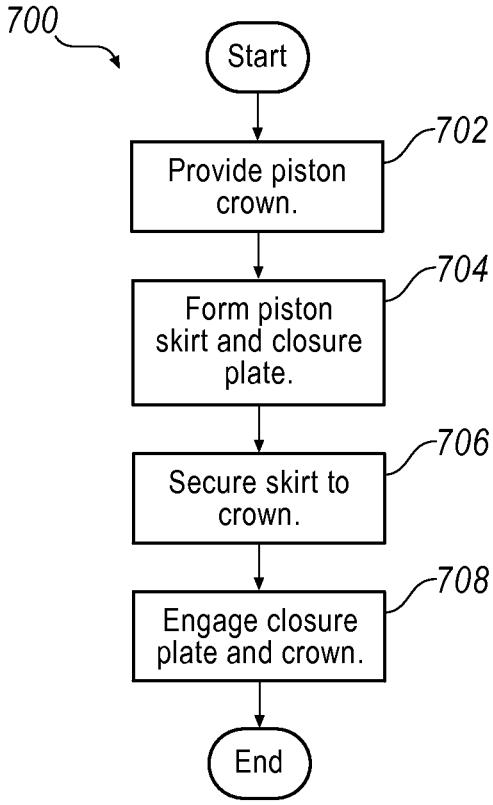
FIG. 9 is a process flow diagram of an exemplary method of assembling a piston.

Turning now to FIG. 9, an exemplary process 700 of making a piston is described. Process 700 may being at block 702, where a piston crown is provided having a ring belt portion defining a cooling gallery, and a strut extending away from the ring belt portion to define a wrist pin bore. For example, as described above a piston crown 22 may be provided that defines a cooling gallery 56 in a ring belt portion 26. Further, a piston crown 22, 122 may include a strut portion 30, 130 that extends away from the ring belt portion 26 to define a wrist pin bore 32, 132. The strut portion 30, 130 and ring belt portion 26, 126 may be formed generally integrally with one another, e.g., in a forging or stamping operation. Process 700 may then proceed to block 704.

In block 704, a piston skirt may be formed having a closure plate integrally formed therewith. For example, as described above two skirt portions 24*a*, 24*b* or 124*a*, 124*b*, respectively, may be provided with integrally formed closure plates 50, 150. Merely as examples, a progressive forging operation may be employed to form the integral skirt portions 24, 124. The skirt 24, 124 may include a bore engagement portion or lower portion 25, 125 configured to interface with bore surfaces of an associated engine during operation, e.g., by sliding along the bore surfaces. Outer surfaces of the bore engagement surfaces of the skirt 24, 124 may be provided with a surface texture, thereby enhancing frictional characteristics of an interface between the skirt 24 and bore surfaces. Additionally, the skirt 24 may be shaped in any configuration that is convenient, e.g., with a "bell" shape that may result from a forging operation, as discussed above. Additionally, the skirt 24, 124 may be formed of a variety of different materials, or even in entirely different types of forming processes. For example, the crown 22, 122 may be cast of a steel material, while the skirt 24, 124 is forged of a different steel material or composite material, merely as examples. Moreover, steel, aluminum, composite, powdered metal, or any other appropriate material may be used in the crown 22, 122 and/or skirt 24, 124 to suit a given application. Process 700 may then proceed to block 706.

In block 706, the skirt may be secured to the crown such that the closure plate generally encloses the cooling gallery. For example, as described above a skirt 24, 124 may be secured to a crown 22, 122 such that a closure plate 50, 150 generally cooperates with interior surfaces of the crown 22, 122 to define a cooling gallery configured to circulate a coolant, e.g., engine oil, through the gallery to generally cool the piston 20, 120 or portions thereof. The skirt 24, 124 may be secured to the crown along corresponding mating surfaces 90, 92. As described above, mating surface 90, 92 of the skirt 24, 124 and crown 22, 122 may extend substantially parallel to a longitudinal axis A-A of the crown. Further, the mating surfaces 90, 92 where the skirt 24, 124 and crown 22, 122 are generally permanently joined may be limited to the strut 30, 130 of the crown 22, 122, thereby simplifying assembly of the piston 20, 120.

Proceeding to block 708, the closure plate 50, 150 may be engaged with the crown 22, 122. For example, features may be provided in the closure plate 50, 150 of the skirt 24, 124, e.g., an extension lip 154. The extension lip 154 may be received in a corresponding feature, e.g., a recess 99, of the crown 22 to enhance radial support of the upper portions of the skirt 24 relative to the crown, thereby reducing a need for additional securement, e.g., by welding, of the skirt 24 to the crown 22. Alternatively, the closure plate 50, 150 may be permanently secured to the crown 22, 122, e.g., by welding, where additional stiffness or stability of the piston 20, 120 is desired.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A piston assembly, comprising:

a piston crown, including:

a ring belt portion defining at least in part a cooling gallery; and a strut extending away from the ring belt portion to define a wrist pin bore; and a separately formed piston skirt assembly secured to the strut, the piston skirt assembly including two skirt portions, each of the skirt portions having a closure plate integrally formed with the skirt portion, the closure plates cooperating to generally enclose the cooling gallery the skirt portions each having radially outer portions, the radially outer portions defining respective cylindrical outer surfaces configured to engage a cylinder bore, the radially outer portions extending upwardly to meet a radially outer end of their respective closure plates, the radially outer ends of the closure plates engaged with the ring belt portion;

wherein the crown defines first mating surfaces extending along the strut;

wherein a first one of the skirt portions defines a second mating surface, and a second one of the skirt portions defines a third mating surface, and the second and third mating surfaces are each fixedly secured to respective first mating surface; and wherein the first, second, and third mating surfaces each extend in a direction substantially parallel to a longitudinal axis of the crown.

2. The piston of claim 1, wherein the first, second, and third mating surfaces are substantially parallel to a longitudinal axis of the crown.

3. The piston of claim 1, wherein the first, second, and third mating surfaces extend substantially straight.

4. The piston of claim 1, wherein the crown and skirt are welded to each other.

5. The piston of claim 1, wherein the first, second, and third mating surfaces are spaced away from the ring belt portion of the crown.

6. The piston of claim 1, wherein the closure plate defines an extension lip for engagement with the crown.

7. The piston of claim 6, wherein the closure plate and ring belt portion are engaged via a recess defined by the ring belt portion, the recess receiving the extension lip of the closure plate.

8. The piston of claim 6, wherein the extension lip is permanently secured to the crown.

9. The piston of claim 1, wherein the crown and skirt are formed of different materials.

10. The piston of claim 1, wherein the closure plate defines a recess extending longitudinally away from the ring belt portion such that the cooling gallery extends below the ring belt portion of the crown.

11. The piston of claim 1, wherein the closure plates each include an extension lip extending toward a center of the piston assembly such that the cooling gallery extends toward the center of the piston assembly.

12. The piston of claim 1, wherein the first mating surface is welded to at least one of the second and third mating surfaces, and wherein welds between the crown and skirt are limited to the strut such that the first, second, and third mating surfaces are each spaced away from the ring belt portion of the crown.

13. The piston of claim 12, wherein an uppermost end of each of the mating surfaces are spaced away longitudinally with respect to the piston from a lowermost end of the ring belt portion.

14. The piston of claim 1, wherein the strut is integrally formed with the ring belt portion.

15. A method of assembling a piston, comprising:

providing a piston crown having a ring belt portion defining a cooling gallery and a strut extending away from the ring belt portion to define a wrist pin bore;

forming a piston skirt assembly separate from the piston crown, including two skirt portions, each skirt portion having a closure plate integrally formed therewith, the skirt portions each having radially outer portions, the radially outer portions defining respective cylindrical outer surfaces configured to engage a cylinder bore;

securing the skirt assembly to the crown such that the closure plates cooperate to generally enclose the cooling gallery, wherein the radially outer portions of the skirt portions each extend upwardly to meet a radially outer end of their respective closure plates, the radially outer ends of the closure plates engaged with the ring belt portion;

establishing the securing of the skirt to the crown as fixedly securing respective first mating surfaces extending along the strut to second and third mating surfaces defined by a first one and a second one of the skirt portions, respectively; and establishing the first, second, and third mating surfaces as extending in a direction substantially parallel to a longitudinal axis of the crown.

16. The method of claim 15, further comprising establishing the first, second and third mating surfaces as substantially parallel to a longitudinal axis of the crown.

17. The method of claim 15, further comprising establishing the first, second, and third mating surface being spaced away from the ring belt portion of the crown.

18. The method of claim 15, further comprising engaging the closure plate and ring belt portion via a recess defined by one of the closure plate and the ring belt portion.

19. The method of claim 15, further comprising establishing the crown and skirt as being formed of different materials.

20. The method of claim 15, wherein securing the skirt assembly to the crown includes welding the first mating surface to at least one of the second and third mating surfaces, wherein welds between the crown and skirt are limited to the strut such that the first, second, and third mating surfaces are each spaced away from the ring belt portion of the crown.

21. The method of claim 20, further comprising:

supporting the skirt portions at a lower portion thereof via the welds between the second and third mating surfaces and the first mating surface, respectively; and supporting the skirt portions at an upper portion thereof via an engagement between the radially outer portion of the closure plate with the ring belt portion.

22. The method of claim 15, wherein providing the piston crown includes forming the strut integrally with the ring belt portion.

23. A piston assembly, comprising:

a piston crown formed of a first material, including:

a ring belt portion defining at least in part a cooling gallery; and a strut integrally formed with the ring belt portion, the strut extending away from the ring belt portion to define a wrist pin bore; and a piston skirt assembly formed separate from the piston crown, the piston skirt assembly formed of a second material different from the first material, the skirt assembly secured to the strut, the piston skirt assembly including two skirt portions, each of the skirt portions having a closure plate integrally formed with the skirt portion, the closure plates each defining an extension lip for engagement with the crown, the closure plates cooperating to generally enclose the cooling gallery, the skirt portions each having radially outer portions, the radially outer portions defining respective cylindrical outer surfaces configured to engage a cylinder bore, the radially outer portions extending upwardly to meet a radially outer end of their respective closure plates, the radially outer ends of the closure plates engaged with the ring belt portion;

wherein the crown defines first mating surfaces extending along the strut;

wherein a first one of the skirt portions defines a second mating surface, and a second one of the skirt portions defines a third mating surface, and the second and third mating surfaces are each fixedly secured to respective first mating surface; and wherein the first, second, and third mating surfaces each extend in a direction substantially parallel to a longitudinal axis of the crown.

* * * * *